US008379492B2

(12) United States Patent
Feng

(10) Patent No.: US 8,379,492 B2
(45) Date of Patent: Feb. 19, 2013

(54) ENERGY SAVING DIGITAL TIMEPIECE

(75) Inventor: QiXiang Feng, Shenzhen (CN)

(73) Assignee: Shenzhen Great Power Enterprise Co., Limited, Shenzhen, Guangdong (CN)

( * ) Notice: Subject to any disclaimer, the term of this patent is extended or adjusted under 35 U.S.C. 154(b) by 705 days.

(21) Appl. No.: 12/552,204

(22) Filed: Sep. 1, 2009

(65) Prior Publication Data

US 2011/0051563 A1 Mar. 3, 2011

(51) Int. Cl.
*G04G 19/02* (2006.01)

(52) U.S. Cl. ..... 368/155; 368/156

(58) Field of Classification Search ..... 368/155, 368/156

See application file for complete search history.

(56) References Cited

U.S. PATENT DOCUMENTS

| | | | | |
|---|---|---|---|---|
| 6,879,498 | B2 * | 4/2005 | Balakrishnan et al. | 363/16 |
| 7,525,259 | B2 * | 4/2009 | Weirich | 315/291 |
| 2007/0007937 | A1 * | 1/2007 | Park et al. | 323/284 |
| 2009/0316533 | A1 * | 12/2009 | Liu | 368/10 |

* cited by examiner

*Primary Examiner* — Renee Luebke

*Assistant Examiner* — Jason Collins

(74) *Attorney, Agent, or Firm* — Raymond Y. Chan; David and Raymond Patent Firm

(57) ABSTRACT

A timepiece includes a casing, a display, a timepiece core unit, and a current processing circuitry. The current processing circuitry includes a rectifying circuitry, an oscillating circuitry, and an output circuitry. The rectifying circuitry is adapted for electrically connected with an AC power source, and arranged to rectify the AC. The oscillating circuitry is electrically connected with the rectifying circuitry, and is arranged to transform the DC outputted from the rectifying circuitry back into AC having a predetermined voltage and a frequency. The output circuitry is electrically connected with the oscillating circuitry, and is arranged to rectifying the AC output from the oscillating circuitry into a DC pulses output, wherein the DC output from the output circuitry is electrically transmitted to the timepiece circuitry for triggering an operation thereof so as to allow the signal generator to generate accurate time signal to display the current time by the display.

11 Claims, 7 Drawing Sheets

ENERGY SAVING DIGITAL TIMEPIECE

BACKGROUND OF THE PRESENT INVENTION

1. Field of Invention

The present invention relates to a timepiece, and more particularly to a digital clock comprising a current processing circuitry which is capable of allowing an energy consumption of the digital clock of the present invention to be substantially less than that of conventional digital clocks.

2. Description of Related Arts

Conventional timepieces can broadly be divided into mechanical timepieces and digital timepieces. With the advance of electrical engineering and widespread applications of information technology, digital timepieces are becoming more popular than their mechanical counterparts. Conventional digital timepieces can in turn be broadly categorized as digital watches in which quartz crystals are used to initiate time signals (with the aid of disposable batteries as power source), and digital clocks in which Alternate Current (AC) is used as raw power source to generate electrical time signals. For the former kind of digital timepieces, an obvious disadvantage of using batteries as power source is that batteries have limited life span and users have to keep on replacing batteries periodically. For the latter kind of digital timepieces (i.e. the digital clocks), most of them require users to electrically connect the timepieces to an existing AC power socket, wherein the AC acquired from the power socket is then transformed and rectified into suitable Direct Current (DC) for use to power up the electrical components received in the digital clock.

There existing a number of different engineering designs for conventional digital clocks. Very broadly speaking, the power circuitries of conventional digital clocks are either internal or external. An internal power circuitry is permanently received in the casing, so that there is only one electric cord extending from the casing for connecting to an external AC power source. A typical internal power circuitry may comprise a transformer and a rectifying circuit received in the casing for processing AC acquired from an external AC power source for use to generate electrical time signal.

There are a number of disadvantages in association with this type of engineering design. First, the transformers used in most of the conventional digital clocks suffer from high energy loss and heat generation. This is primarily because of low frequency transformation of electrical current which leads to a relatively large amount of energy loss. In average, the transformers used in most digital clocks have a mere 30% efficiency when transforming AC. Second, most transformers used in conventional digital clocks occupy a relatively large volume of space due to the need of using a relatively large transformer core. This accordingly increases the size and weight of the corresponding casings, and explains why most digital clocks having an internal power circuitry are bulky in size. Third, many digital clocks implementing internal power circuitry design can only be used for a specified input voltage (such as 110V or 220V). In other words, users cannot use the digital clocks in different countries providing AC of different voltages. Because of the above disadvantages, conventional digital clocks consume a lot of electrical energy and most of the consumed energy is lost due to inefficient power transforming technique.

As mentioned earlier, there exist digital clocks which have external power circuitries provided out of the casing. For this kind of digital clocks, a typical user has to electrically connect a transformer hub between the digital clock and an external AC power source. While this engineering design resolves the problem of bulky casing, it merely carries the original problem to other part of the digital clock. Inefficient power transformation remains to be resolved. Moreover, since the transformer hub is now producing a substantial amount of heat and is bulky in size (because of the above mentioned reasons: namely low frequency transformation of electrical current), it poses other problems. For example, a transformer hub having high temperature may create potential risk to children.

SUMMARY OF THE PRESENT INVENTION

A main object of the present invention is to provide to a digital timepiece, such as a digital clock, comprising a current processing circuitry which is capable of having an energy consumption and efficiency of the digital clock of the present invention to be substantially less than that of conventional digital clocks.

Another object of the present invention is to provide a digital timepiece, such as a digital clock, comprising a current processing circuitry which allows for high efficient power transformation with minimum energy loss (i.e. prevention of overheat at the transformer). As a result, the current processing circuitry does not share the above mentioned size and weight problem, regardless whether or not it is externally extended out of the casing, or even internally received in the casing of the digital clock.

Another object of the present invention is to provide a digital timepiece, such as a digital clock, comprising a current processing circuitry which is capable of providing a stable power output for generating accurate and consistent time display.

Another object of the present invention is to provide a digital timepiece, such as a digital clock, comprising a current processing circuitry which allows the digital clock to be used in a wide variety of geographical areas (i.e. in different countries) while maintaining efficient power transformation and stable power output.

Another object of the present invention is to provide a digital timepiece, such as a digital clock, comprising a current processing circuitry Accordingly, in order to accomplish the above object, the present invention provides an energy saving timepiece, comprising:

a casing;

a display provided on the casing;

a timepiece core unit comprising a timepiece circuitry received in the casing and electrically connected with the display for generating display of current time by the display, wherein the timepiece circuitry comprises a signal generator which is adapted to generate a time signal of a predetermined frequency; and a current processing circuitry electrically extended out of the casing, and comprises:

a rectifying circuitry which is adapted for electrically connecting with an external AC power source, and arranged to convert the AC into DC of a predetermined magnitude;

an oscillating circuitry electrically connected with the rectifying circuitry, and arranged to transform the DC outputted from the rectifying circuitry back into AC pulses having a predetermined elevated voltage and a frequency which is equal the frequency of the time signal of the signal generator; and an output circuitry electrically connected with the oscillating circuitry, and is arranged to rectify the AC output from the oscillating circuitry into a DC output having a predetermined voltage, wherein the DC output from the output circuitry is electrically transmitted to the timepiece circuitry for triggering an operation thereof so as to allow the signal generator to generate accurate time signal to display the current time by the display.

These and other objectives, features, and advantages of the present invention will become apparent from the following detailed description, the accompanying drawings, and the appended claims.

DETAILED DESCRIPTION OF THE PREFERRED EMBODIMENT

Figure 1:
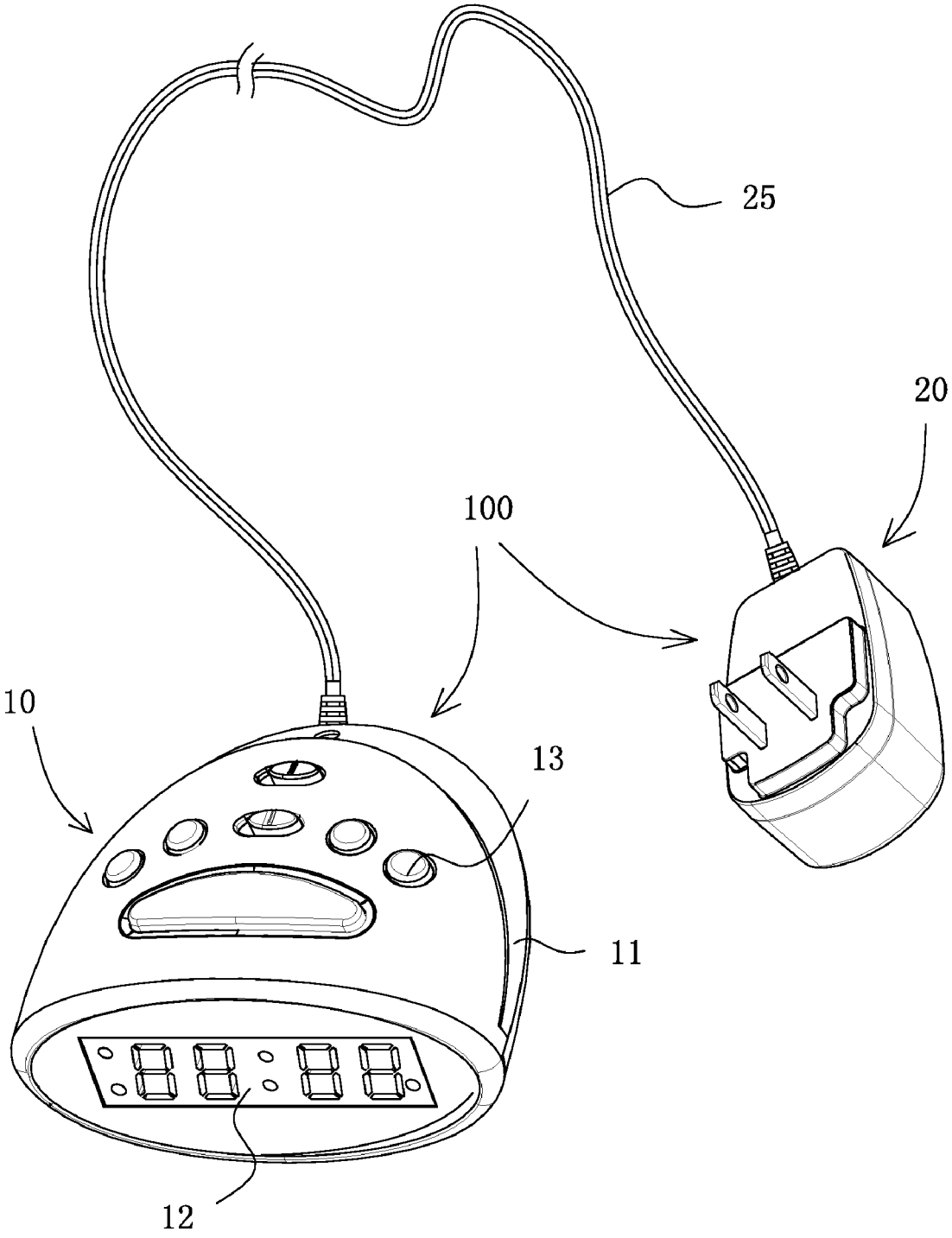
FIG. 1 is a perspective view of an energy saving timepiece according to a preferred embodiment of the present invention.
Figure 2:
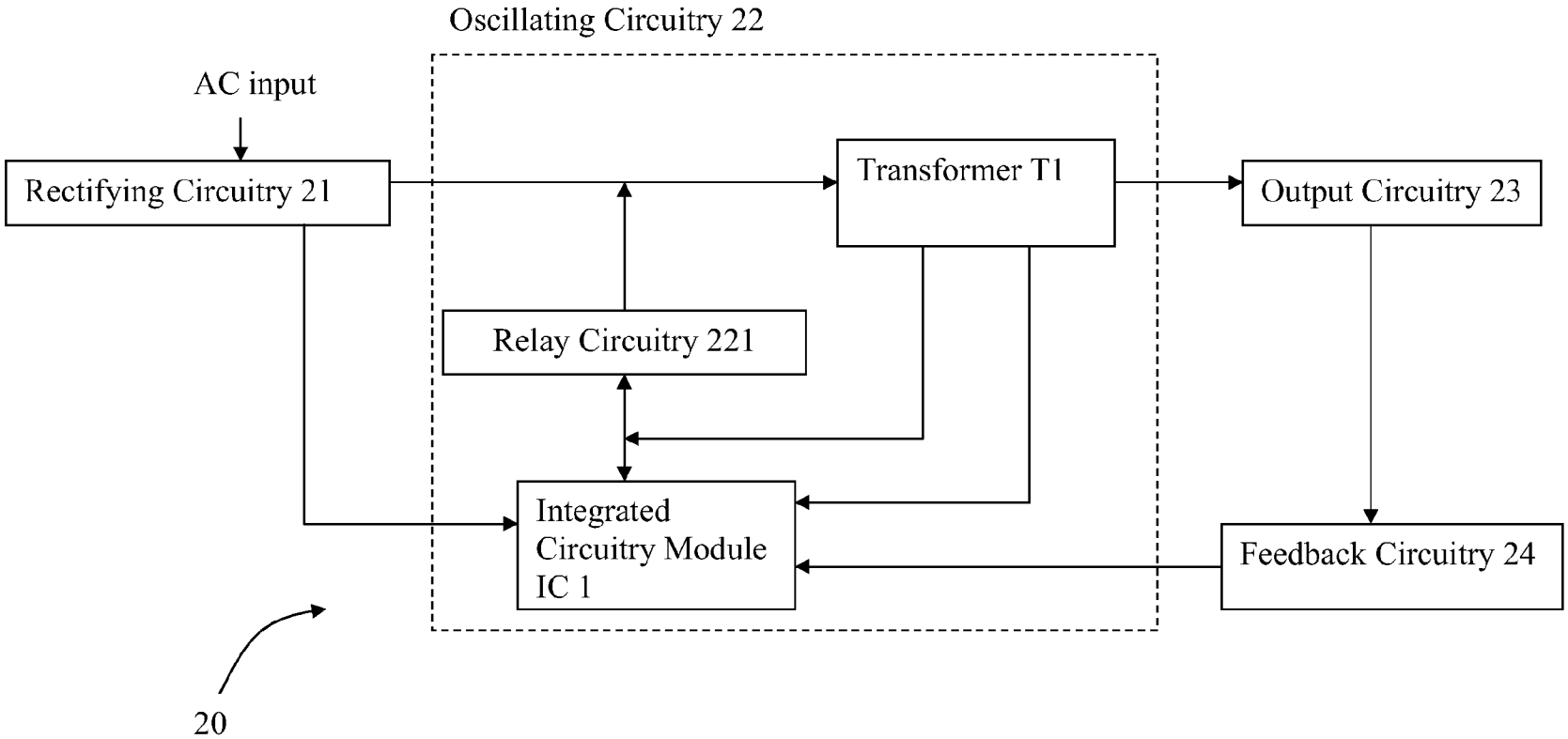
FIG. 2 is a schematic diagram of the energy saving timepiece according to the above preferred embodiment of the present invention.

Referring to FIG. 1 to FIG. 5 of the drawings, an energy saving timepiece, such as a digital clock, according to a preferred embodiment of the present invention is illustrated, in which the energy saving timepiece comprises a casing 10, a display 12 provided on the casing 10, a timepiece core unit 31, and a current processing circuitry 20.

The timepiece core unit 31 comprises a timepiece circuitry 30 received in the casing 10 and electrically connected with the display 12 for generating a LED (the preferred embodiment) or LCD (the alternative mode mentioned below) display of current time, wherein the timepiece circuitry 30 comprises a signal generator 32 which is adapted to generate a time signal of a predetermined frequency to be displayed by the display 12.

The current processing circuitry 20 is electrically extended out of the casing 10 preferably via a cable 25, and comprises a rectifying circuitry 21, an oscillating circuitry 22, and an output circuitry 23. The rectifying circuitry 21 is adapted for electrically connecting with an external AC power source such as a wall AC power socket, and arranged to rectify the AC into DC pulses of a predetermined magnitude.

On the other hand, the oscillating circuitry 22 is electrically connected with the rectifying circuitry 21, and arranged to transform the DC outputted from the rectifying circuitry 21 back into AC pulses having a predetermined elevated voltage and a frequency which is equal the frequency of the time signal of the signal generator 32.

The output circuitry 23 is electrically connected with the oscillating circuitry 22, and is arranged to rectifying the AC output from the oscillating circuitry 22 into a DC output having a predetermined voltage, wherein the DC output from the output circuitry 23 is electrically transmitted to the timepiece circuitry 30 for triggering an operation thereof so as to allow the signal generator 32 to generate accurate time signal to display the current time by the display 12.

According to the preferred embodiment of the present invention, the casing is a typical plastic or metal casing for a digital clock, and can be embodied as having a wide variety of shapes and colors. On the other hand, the display 12 can be a LCD display or a LED display which capable of generating digital image for illustration of current time or other information (such as date).

Moreover, in order to stabilize the AC output from the output circuitry 23, the current processing circuitry 20 further comprises a feedback circuitry 24 electrically connecting between the output circuitry 23 and the oscillating circuitry 22 for adjusting any deviation of the AC output from output circuitry 23 in order to ensure the consistency of the AC provided to the timepiece circuitry 30, so as to ensure consistent performance of the time displaying function of the digital clock of the present invention.

The rectifying circuitry 21 comprises a fuse, a rectifier U1, capacitors C1, C2, an inductor L1 and resistor R1 electrically connected together for rectifying the inputted AC from the external AC power source. In other words, the input of the rectifying circuitry 21 is electrically connected with the external AC power source. It is worth mentioning that the rectifying circuitry 21 is designed to rectify AC having a range of 90V-240V with 50 Hz-60 Hz frequency, so that a user of the present invention may be able to use the digital clock of the present invention in most of the countries all over the world. After rectifying, the output of the rectifying circuitry 21 would be DC pulse having a predetermined magnitude (i.e. voltage).

The oscillating circuitry 22 comprises a transformer T1 having a primary side and a secondary side, a relay circuitry 221 electrically connected to the primary side of the transformer T1, an Integrated Circuit module IC1, and a power control circuitry 222. More specifically, the transformer T1 comprises a primary winding (1, 3) formed at the primary side of the transformer T1, a secondary winding (6, 10) formed at the secondary side of the transformer T1 and is electrically connected to the output circuitry 23, and a feedback winding (2, 4, 5) formed on the primary side of the transformer T1 and is electrically connected with the power control circuitry 222 of the oscillating circuitry 22.

The relay circuitry 221 comprises a diode D1, a resistor R3, and a capacitor R5, wherein the diode D1 has an anode electrically connected with the primary winding (3) of the transformer T1 and the Integrated Circuit module IC1, and a cathode electrically connected with the resistor R3 and the capacitor C5 in parallel. When the Integrated Circuit module IC1 is activated, the primary winding (1, 3) will be applied the DC pluses pulse outputted from the rectifying circuitry 21, and the transformer T1 is induced with magnetic flux which induces e.m.f. at the secondary winding (6, 10) and the feedback winding (2, 4, 5). Moreover, the electric current produced at the primary winding (1, 3) is simultaneously transmitted to the capacitor C5 and the resistor R3 of the relay circuitry 221 for temporary storage. As a result, energy loss due at the transformer T1 can be minimized as the induced current at the primary side of the transformer T1 is properly transmitted to the relay circuitry 221 for temporary storage.

The power control circuitry 222 comprises a diode D3 and a capacitor C6, wherein the diode D3 has an anode electrically connected with the feedback winding (2, 4, 5) of the transformer T1, and a cathode electrically connected with the capacitor C6 and one of the input terminals of the Integrated Circuit module IC1. The power control circuitry 222 is for providing a controlled power supply to the Integrated Circuit module IC1. The secondary winding (6, 10) of the transformer T1 is then induced to have AC having a predetermined frequency and power. The induced AC at the secondary winding (6, 10) is then transmitted to the output circuitry 23.

Figure 3:
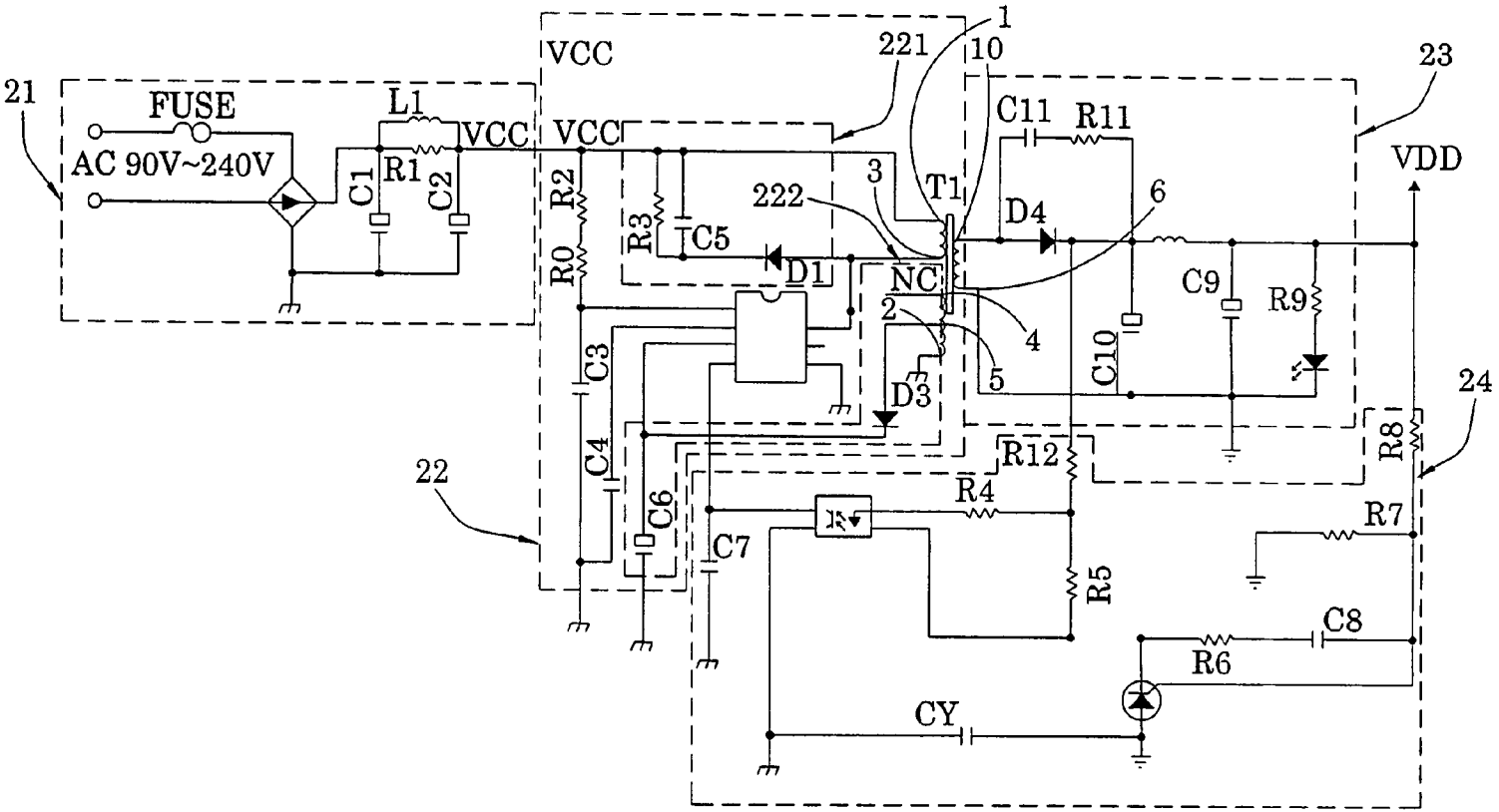
FIG. 3 is a circuit diagram of the current processing circuitry according to the above preferred embodiment of the present invention.

Referring to FIG. 3 of the drawings, the output circuitry 23 comprises a diode D4, a capacitor C9, a capacitor C10, a capacitor C11, an inductor L3, and a resistor R11, wherein the diode D4, the capacitor C11, and the resistor R11 are electrically connected with the secondary winding (6, 10) of the transformer T1 for forming a sub-rectifying circuit for rectifying the AC output into DC. Moreover, the capacitor C9, the capacitor C10, and the inductor L3 are electrically connected with said sub-rectifying circuitry formed by the diode D4, the capacitor C11, and the resistor R11 as a capacitor-input filter for producing steady DC from the output of the sub-rectifying circuit formed by the fourth diode D4, the eleventh capacitor C11, and the resistor R11. The preferred DC output of the output circuitry 23 is 5V DC.

The feedback circuitry 24 comprises a transistor Q2, a capacitor C8; a resistor R4, a resistor R5, a resistor R6, a resistor R7, a resistor R8, a resistor R12, and an opto-isolator IC2, wherein the transistor Q2, the capacitor C8, the resistor R6, the resistor R7, and the resistor R8 form a reference circuit, while the opto-isolator IC2, the resistor R4 the resistor R5, and the resistor R12 form a feedback sub-circuitry, wherein the feedback circuitry 24 is electrically connected between the output circuitry 23 and the Integrated Circuit module IC1 for transmitting a difference in voltage between the output voltage of the output circuitry 23 and the preferred voltage (5V) back to the Integrated Circuit module IC1.

When the output voltage of the output circuitry 23 is less than the preferred voltage, the corresponding electrical signal is transmitted from the feedback circuitry 24 back to the Integrated Circuit module IC1, which is arranged to be pre-programmed to adjust the corresponding parameters of the oscillating circuitry 22 for increasing the output voltage of the output circuitry 23. Conversely, when the output voltage of the output circuitry 23 is more than the preferred voltage, the corresponding electrical signal is transmitted from the feedback circuitry 24 back to the Integrated Circuit module IC1, which is arranged to be pre-programmed to adjust the corresponding parameters of the oscillating circuitry 22 for decreasing the output voltage of the output circuitry 23. Therefore, the output voltage of the output circuitry 23 will be maintained at a predetermined value. Note that the above mentioned 5V is just an example of the output voltage. One having ordinary skill in the art would have appreciated that any other output values can also be adopted for different operation circumstances of the digital clock.

Figure 4:
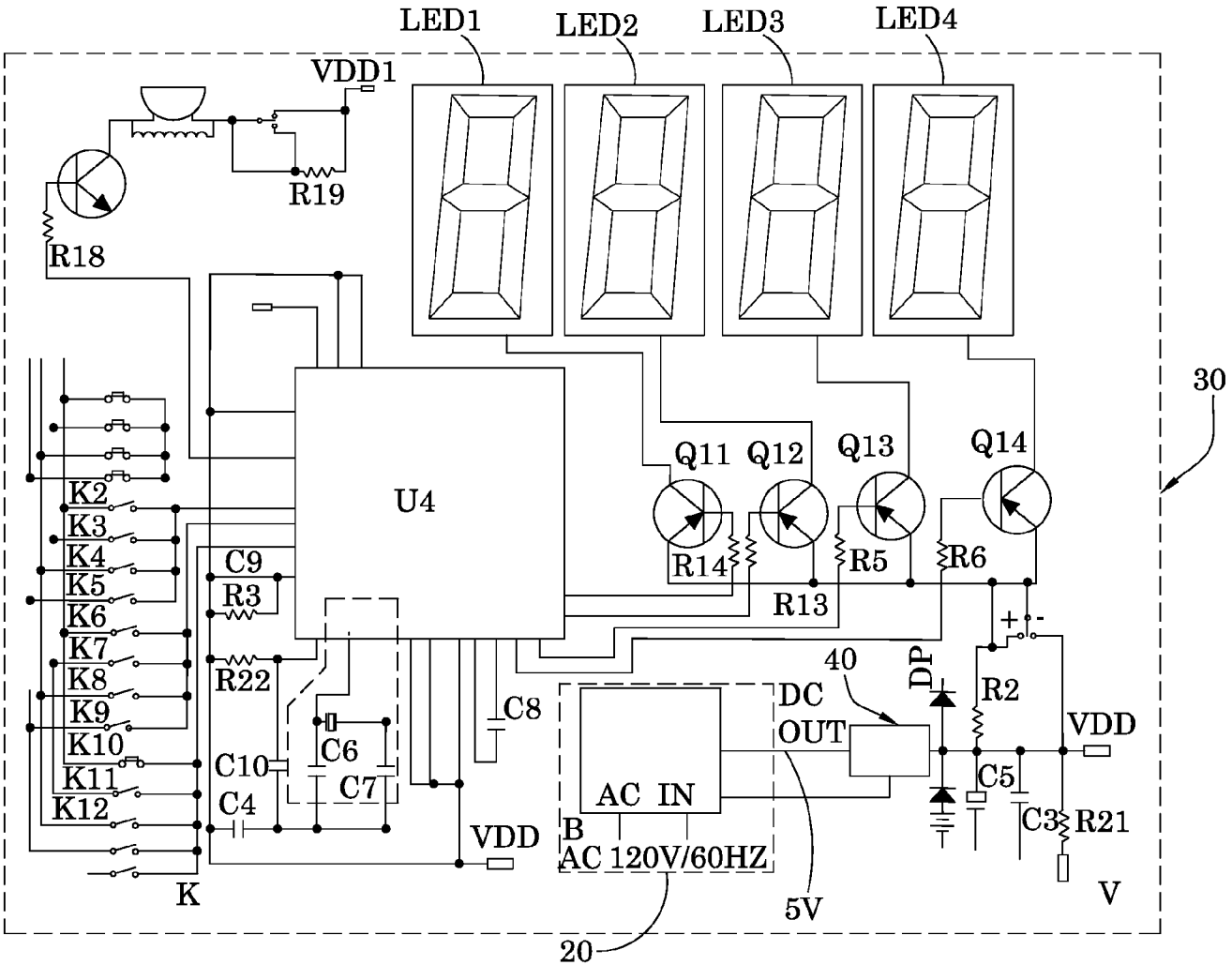
FIG. 4 is an overall circuit diagram of the energy saving timepiece according to the above preferred embodiment of the present invention.
Figure 5:
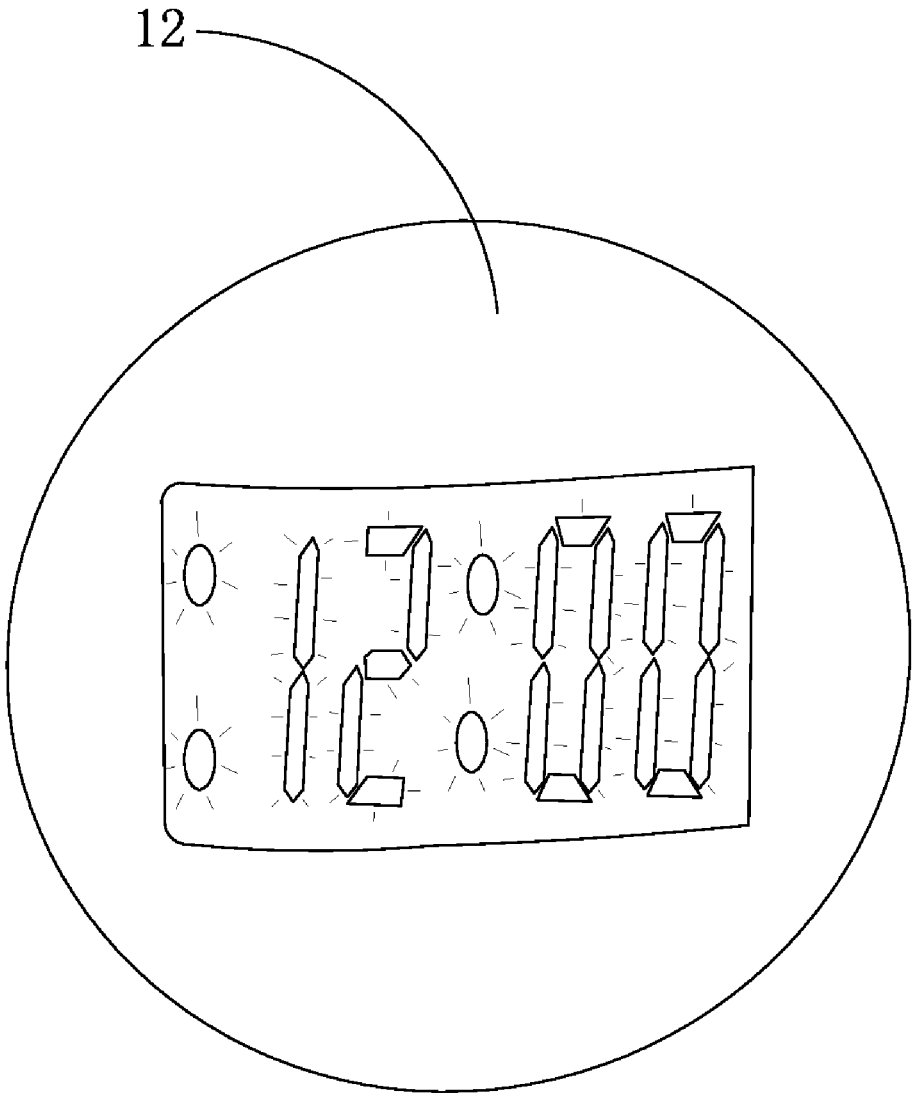
FIG. 5 is a schematic diagram of the display of the energy saving timepiece according to the above preferred embodiment of the present invention.

Referring to FIG. 4 to FIG. 5 of the drawings, the timepiece circuitry 30 comprises a main control unit (MCU) U4, a plurality of transistors (Q11, Q12, Q13, Q14) connected with the main control unit U4, and a plurality of LEDs (LED 1, LED 2, LED 3, LED 4) electrically connected with the transistors (Q11, Q12, Q13, Q14) respectively. The output from the rectifying circuitry 20 is fed into the main control unit U4 so that the main control unit U4 can be able to control display of time information through the transistors (Q11, Q12, Q13, Q14) and the LEDs (LED 1, LED 2, LED 3, LED 4). FIG. 5 is an illustration of the display 12 of the digital numerals of the digital clock of the present invention.

Figure 6:
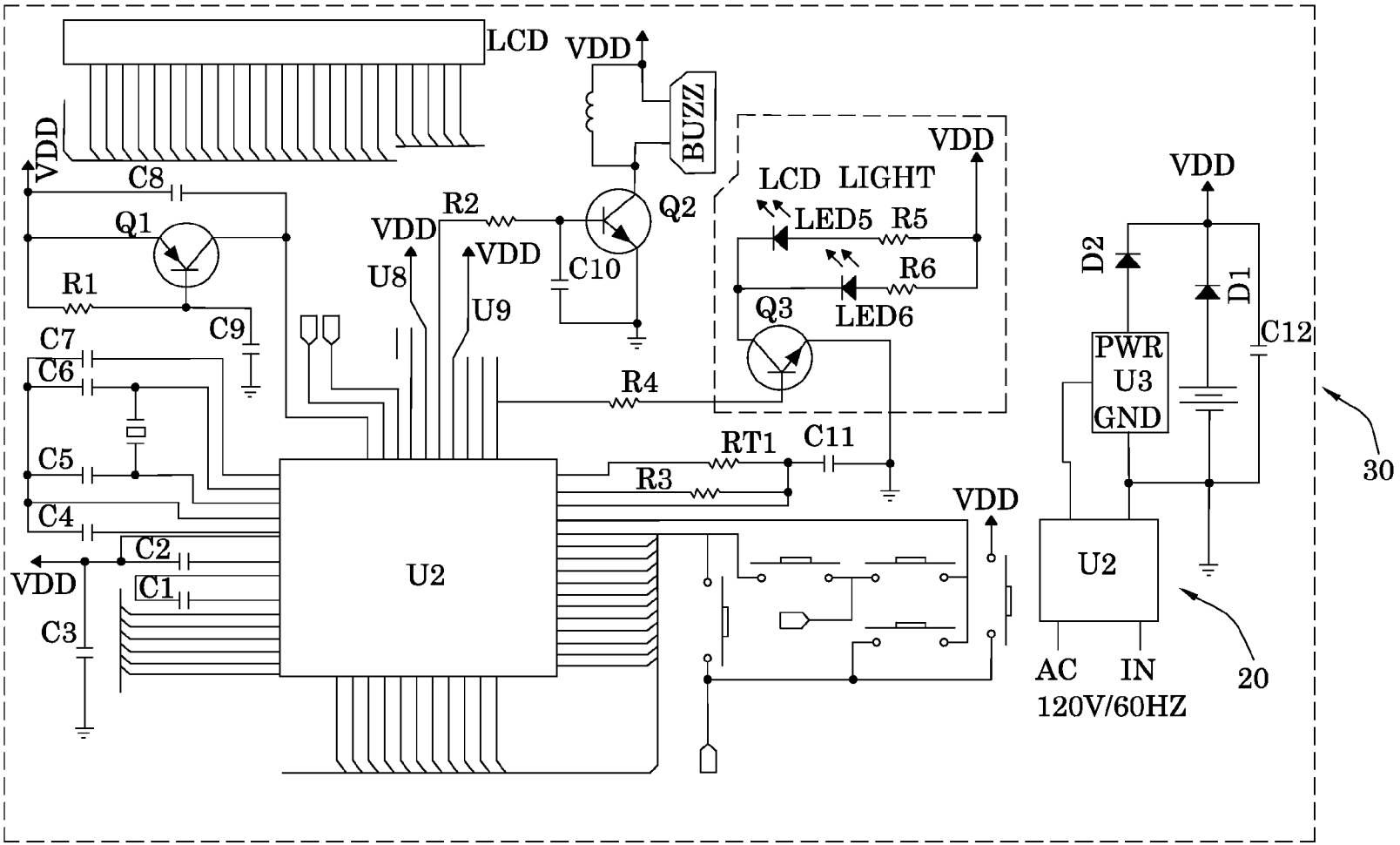
FIG. 6 is an alternative mode of the energy saving timepiece according to the above preferred embodiment of the present invention.
Figure 7:
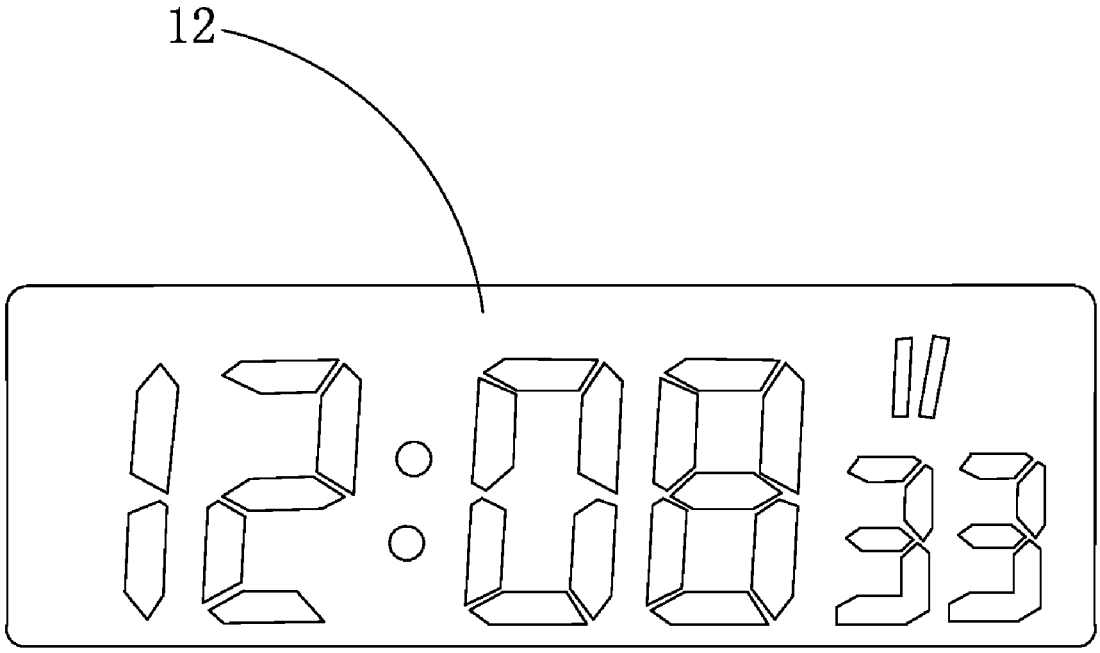
FIG. 7 is the schematic diagram of the display according to the alternative mode of the energy saving timepiece of the present invention.

Referring to FIG. 6 to FIG. 7 of the drawings, an alternative mode of the energy saving timepiece according to the preferred embodiment of the present invention is illustrated. The alternative mode is similar to the preferred embodiment except the timepiece circuitry 30' and the display 12'. According to the alternative mode, the display 12' is a LCD unit while the timepiece circuitry 30' comprises a plurality of LEDs (LED 5, LED 6) for providing background illumination to the LCD. As a result, the timepiece circuitry 30' comprises a main control unit (MCU) U2, a transistors Q3 connected with the main control unit U4, and a plurality of LEDs (LED 5, LED 6) electrically connected with the transistors Q3. The output from the rectifying circuitry 20 is fed into the main control unit U4 so that the main control unit U2 can be able to control display of time information through the transistors Q3 and the LEDs (LED 5, LED 6). FIG. 7 is an illustration of the display 12' of the digital numerals of the digital clock of the present invention.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A timepiece, comprising:

a casing;

a display provided on said casing;

a timepiece core unit comprising a timepiece circuitry received in said casing and electrically connected with said display for generating display of current time by said display, wherein said timepiece circuitry comprises a signal generator which is adapted to generate a time signal of a predetermined frequency; and a current processing circuitry, which is electrically extended out of said casing, comprising:

a rectifying circuitry, which is adapted for electrically connecting with an external AC power source and arranged to convert said AC into DC of a predetermined magnitude, comprising a fuse, a rectifier, a first and a second capacitor, an inductor, and a resistor electrically connected for rectifying said inputted AC from said external AC power source;

an oscillating circuitry, which is electrically connected with said rectifying circuitry and arranged to transform said DC outputted from said rectifying circuitry back into AC, having a predetermined voltage and a frequency which is equal said frequency of said time signal of said signal generator, wherein said oscillating circuitry comprises a transformer having a primary side and a secondary side, a relay circuitry electrically connected to the primary side of said transformer, an Integrated Circuit module, and a power control circuitry, wherein said transformer comprises a primary winding formed at said primary side of said transformer, a secondary winding formed at said secondary side of said transformer, and a feedback winding also formed on said primary side of said transformer and is electrically connected with said power control circuitry of said oscillating circuitry, wherein said power control circuitry comprises a diode and a capacitor, wherein said diode has an anode electrically connected with said feedback winding of said transformer, and a cathode electrically connected with said capacitor of said power control circuitry and said Integrated Circuit module for providing a controlled power supply to said Integrated Circuit module;

an output circuitry, which is electrically connected with said oscillating circuitry and arranged to rectify said AC output from said oscillating circuitry into a DC pulses output, having a predetermined voltage, wherein said secondary winding formed at said secondary side of said transformer is electrically connected to said output circuitry, wherein said DC output from said output circuitry is electrically transmitted to said timepiece circuitry for triggering an operation thereof so as to allow said signal generator to generate accurate time signal to display said current time by said display; and a feedback circuitry electrically connecting between said output circuitry and said oscillating circuitry for adjusting deviation of said DC output from said output circuitry in order to ensure the consistency of the AC provided to the timepiece circuitry, so as to ensure consistent performance of time displaying function of said timepiece core unit.

2. The timepiece, as recited in claim 1, wherein said relay circuitry comprises a diode, a resistor, and a capacitor, wherein said diode has an anode electrically connected with said primary winding of said transformer and said Integrated Circuit module, and a cathode electrically connected with said resistor and said capacitor in parallel, wherein when said Integrated Circuit module is activated, said primary winding is applied with DC pulses outputted from said rectifying circuitry, and said transformer is induced with magnetic flux which induces e.m.f. at said secondary winding and said feedback winding, so that said electric current produced at said primary winding is simultaneously transmitted to said capacitor and said resistor of said relay circuitry for temporary storage, so as to minimize energy loss at said transformer.

3. The timepiece, as recited in claim 2, wherein said output circuitry comprises a diode, three capacitors, an inductor, and a resistor, wherein said diode of said output circuitry, one of said capacitors of said output circuitry, and said resistor of said output circuitry are electrically connected with said secondary winding of said transformer for forming a sub-rectifying circuit for rectifying said AC output into DC, wherein other two of said capacitors of said output circuitry and said inductor of said output circuitry are electrically connected to form a capacitor-input filter, wherein said capacitor-input filter is electrically connected with said sub-rectifying circuit for producing steady DC from an output of said sub-rectifying circuit.

4. The timepiece, as recited in claim 3, wherein said feedback circuitry comprises a transistor, a capacitor, six resistors, and an opto-isolator, wherein said transistor, said capacitor, and three of said resistors of said feedback circuitry are electrically connected to form a reference circuit, while said opto-isolator, and said remaining three of said resistors of said feedback circuitry are electrically connected to form a feedback sub-circuitry, which is electrically connected between said output circuitry and said Integrated Circuit module for transmitting a difference in voltage between an actual output voltage of said output circuitry and a preferred voltage back to said Integrated Circuit module, wherein said Integrated Circuit module is pre-programmed to adjust said actual output value of said output circuitry to ensure consistent electrical output to said timepiece core unit.

5. The timepiece, as recited in claim 4, wherein said timepiece circuitry comprises a main control unit, a plurality of transistors connected with said main control unit, and a plurality of LEDs electrically connected with said transistors respectively, wherein said output from said rectifying circuitry is fed into said main control unit so that said main control unit is arranged to control display of time information through said LEDs.

6. The timepiece, as recited in claim 4, wherein said display is a LCD unit, while said timepiece circuitry comprises a main control unit, a transistor connected with said main control unit, and a plurality of LEDs electrically connected with said transistor of said timepiece circuitry for controllably providing illumination to said LCD unit.

7. The timepiece, as recited in claim 2, wherein said feedback circuitry comprises a transistor, a capacitor, six resistors, and an opto-isolator, wherein said transistor, said capacitor, and three of said resistors of said feedback circuitry are electrically connected to form a reference circuit, while said opto-isolator, and said remaining three of said resistors of said feedback circuitry are electrically connected to form a feedback sub-circuitry, which is electrically connected between said output circuitry and said Integrated Circuit module for transmitting a difference in voltage between an actual output voltage of said output circuitry and a preferred voltage back to said Integrated Circuit module, wherein said Integrated Circuit module is pre-programmed to adjust said actual output value of said output circuitry to ensure consistent electrical output to said timepiece core unit.

8. The timepiece, as recited in claim 1, wherein said output circuitry comprises a diode, three capacitors, an inductor, and a resistor, wherein said diode of said output circuitry, one of said capacitors of said output circuitry, and said resistor of said output circuitry are electrically connected with said secondary winding of said transformer for forming a sub-rectifying circuit for rectifying said AC output into DC, wherein other two of said capacitors of said output circuitry and said inductor of said output circuitry are electrically connected to form a capacitor-input filter, wherein said capacitor-input filter is electrically connected with said sub-rectifying circuit for producing steady DC from an output of said sub-rectifying circuit.

9. A timepiece, comprising:

a casing;

a display provided on said casing;

a timepiece core unit comprising a timepiece circuitry received in said casing and electrically connected with said display for generating display of current time by said display, wherein said timepiece circuitry comprises a signal generator which is adapted to generate a time signal of a predetermined frequency; and a current processing circuitry, which is electrically extended out of said casing, comprising:

a rectifying circuitry, which is adapted for electrically connecting with an external AC power source and arranged to convert said AC into DC of a predetermined magnitude;

an oscillating circuitry, which is electrically connected with said rectifying circuitry and arranged to transform said DC outputted from said rectifying circuitry back into AC, having a predetermined voltage and a frequency which is equal said frequency of said time signal of said signal generator, wherein said oscillating circuitry comprises a transformer having a primary side and a secondary side, a relay circuitry electrically connected to the primary side of said transformer, an Integrated Circuit module, and a power control circuitry, wherein said transformer comprises a primary winding formed at said primary side of said transformer, a secondary winding formed at said secondary side of said transformer, and a feedback winding also formed on said primary side of said transformer and is electrically connected with said power control circuitry of said oscillating circuitry, wherein said power control circuitry comprises a diode and a capacitor, wherein said diode has an anode electrically connected with said feedback winding of said transformer, and a cathode electrically connected with said capacitor of said power control circuitry and said Integrated Circuit module for providing a controlled power supply to said Integrated Circuit module, wherein said relay circuitry comprises a diode, a resistor, and a capacitor, wherein said diode has an anode electrically connected with said primary winding of said transformer and said Integrated Circuit module, and a cathode electrically connected with said resistor and said capacitor in parallel, wherein when said Integrated Circuit module is activated, said primary winding is applied with DC pulses outputted from said rectifying circuitry, and said transformer is induced with magnetic flux which induces e.m.f. at said secondary winding and said feedback winding, so that said electric current produced at said primary winding is simultaneously transmitted to said capacitor and said resistor of said relay circuitry for temporary storage, so as to minimize energy loss at said transformer;

an output circuitry, which is electrically connected with said oscillating circuitry and arranged to rectify said AC output from said oscillating circuitry into a DC pulses output, having a predetermined voltage, wherein said secondary winding formed at said secondary side of said transformer is electrically connected to said output circuitry, wherein said DC output from said output circuitry is electrically transmitted to said timepiece circuitry for triggering an operation thereof so as to allow said signal generator to generate accurate time signal to display said current time by said display; and a feedback circuitry electrically connecting between said output circuitry and said oscillating circuitry for adjusting deviation of said DC output from said output circuitry in order to ensure the consistency of the AC provided to the timepiece circuitry, so as to ensure consistent performance of time displaying function of said timepiece core unit.

10. The timepiece, as recited in claim 9, wherein said output circuitry comprises a diode, three capacitors, an inductor, and a resistor, wherein said diode of said output circuitry, one of said capacitors of said output circuitry, and said resistor of said output circuitry are electrically connected with said secondary winding of said transformer for forming a sub-rectifying circuit for rectifying said AC output into DC, wherein other two of said capacitors of said output circuitry and said inductor of said output circuitry are electrically connected to form a capacitor-input filter, wherein said capacitor-input filter is electrically connected with said sub-rectifying circuit for producing steady DC from an output of said sub-rectifying circuit.

11. A timepiece, comprising:

a casing;

a display provided on said casing;

a timepiece core unit comprising a timepiece circuitry received in said casing and electrically connected with said display for generating display of current time by said display, wherein said timepiece circuitry comprises a signal generator which is adapted to generate a time signal of a predetermined frequency; and a current processing circuitry electrically extended out of said casing, comprising:

a rectifying circuitry which is adapted for electrically connecting with an external AC power source and arranged to convert said AC into DC of a predetermined magnitude, wherein said rectifying circuitry comprises a fuse, a rectifier, a first and a second capacitor, an inductor, and a resistor electrically connected for rectifying said inputted AC from said external AC power source;

an oscillating circuitry, which is electrically connected with said rectifying circuitry and arranged to transform said DC outputted from said rectifying circuitry back into AC, having a predetermined voltage and a frequency which is equal said frequency of said time signal of said signal generator, wherein said oscillating circuitry comprises a transformer having a primary side and a secondary side, a relay circuitry electrically connected to the primary side of said transformer, an Integrated Circuit module, and a power control circuitry, wherein said transformer comprises a primary winding formed at said primary side of said transformer, a secondary winding formed at said secondary side of said transformer, and a feedback winding also formed on said primary side of said transformer and is electrically connected with said power control circuitry of said oscillating circuitry, wherein said relay circuitry comprises a diode, a resistor, and a capacitor, wherein said diode has an anode electrically connected with said primary winding of said transformer and said Integrated Circuit module, and a cathode electrically connected with said resistor and said capacitor in parallel, wherein when said Integrated Circuit module is activated, said primary winding is applied with DC pulses outputted from said rectifying circuitry, and said transformer is induced with magnetic flux which induces e.m.f. at said secondary winding and said feedback winding, so that said electric current produced at said primary winding is simultaneously transmitted to said capacitor and said resistor of said relay circuitry for temporary storage, so as to minimize energy loss at said transformer;

an output circuitry, which is electrically connected with said oscillating circuitry and is arranged to rectify said AC output from said oscillating circuitry into a DC pulses output, having a predetermined voltage, wherein said secondary winding formed at said secondary side of said transformer is electrically connected to said output circuitry, wherein said DC output from said output circuitry is electrically transmitted to said timepiece circuitry for triggering an operation thereof so as to allow said signal generator to generate accurate time signal to display said current time by said display; and a feedback circuitry electrically connecting between said output circuitry and said oscillating circuitry for adjusting deviation of said DC output from said output circuitry in order to ensure the consistency of the AC provided to the timepiece circuitry, so as to ensure consistent performance of time displaying function of said timepiece core unit, wherein said feedback circuitry comprises a transistor, a capacitor, six resistors, and an opto-isolator, wherein said transistor, said capacitor, and three of said resistors of said feedback circuitry are electrically connected to form a reference circuit, while said opto-isolator, and said remaining three of said resistors of said feedback circuitry are electrically connected to form a feedback sub-circuitry, which is electrically connected between said output circuitry and said Integrated Circuit module for transmitting a difference in voltage between an actual output voltage of said output circuitry and a preferred voltage back to said Integrated Circuit module, wherein said Integrated Circuit module is pre-programmed to adjust said actual output value of said output circuitry to ensure consistent electrical output to said timepiece core unit.

* * * * *